US008505160B2

(12) United States Patent
Yoo

(10) Patent No.: US 8,505,160 B2
(45) Date of Patent: Aug. 13, 2013

(54) VACUUM CLEANER

(75) Inventor: Dong-hun Yoo, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 1128 days.

(21) Appl. No.: 12/156,325

(22) Filed: May 30, 2008

(65) Prior Publication Data

US 2009/0178234 A1 Jul. 16, 2009

(30) Foreign Application Priority Data

Mar. 25, 2008 (KR) ..... 10-2008-0027449

(51) Int. Cl.
*A47L 9/10* (2006.01)

(52) U.S. Cl.
USPC ..... 15/352; 15/351

(58) Field of Classification Search
USPC ..... 15/350–353, 323, 361, DIG. 8
See application file for complete search history.

(56) References Cited

U.S. PATENT DOCUMENTS

| | | | | |
|---|---|---|---|---|
| 6,991,667 | B2 * | 1/2006 | Yang et al. | 55/429 |
| 7,191,490 | B2 * | 3/2007 | Lee et al. | 15/352 |
| 2004/0261216 | A1 * | 12/2004 | Choi et al. | 15/352 |
| 2008/0282497 | A1 * | 11/2008 | Griffith et al. | 15/352 |

FOREIGN PATENT DOCUMENTS

| | | |
|---|---|---|
| JP | 2006-167186 | 6/2006 |
| KR | 1020030092563 | 12/2003 |
| WO | 2007/021147 | 2/2007 |

OTHER PUBLICATIONS

Search Report dated Nov. 21, 2008 corresponding to United Kingdom Patent Application No. 0813489.2.

* cited by examiner

*Primary Examiner* — Dung Van Nguyen
(74) *Attorney, Agent, or Firm* — Ohlandt, Greeley, Ruggiero & Perle, LLP.

(57) ABSTRACT

A vacuum cleaner includes a cleaner body housing a cyclone dust separating unit therein, a dust receptacle removably mounted in the cyclone dust separating unit, a carrying handle movable at a front of the dust receptacle to protrude out or withdraw in, for carrying of the dust receptacle, and a lifting unit to move in accordance with the protruding or withdrawal of the carrying handle, so as to lock the dust receptacle with the cyclone dust separating unit when the carrying handle is withdrawn in the dust receptacle, and to unlock the dust receptacle from the cyclone dust separating unit when the carrying handle protrudes out of the dust receptacle.

7 Claims, 11 Drawing Sheets

VACUUM CLEANER

REFERENCE TO RELATED APPLICATIONS

This application claims the benefit under 35 U.S.C. §119 (e) of U.S. Provisional Application No. 61/011,344, filed on Jan. 16, 2008, in the United States Patent and Trademark Office, and the benefit under 35 U.S.C. §119(a) of Korean Patent Application No. 10-2008-0027449, filed on Mar. 25, 2008, in the Korean Intellectual Property Office, the entire of both of which are hereby incorporated by reference.

BACKGROUND OF THE INVENTION

1. Field of the Invention

The present disclosure relates to a vacuum cleaner, and more particularly, to a vacuum cleaner having a dust receptacle which is easy to mount and remove.

2. Description of the Related Art

Various types of vacuum cleaners are now available for cleaning different types of objects. An upright type cleaner is effective for cleaning a plane and wide area. As it generally covers large area, the upright type cleaner employs a larger dust receptacle than other type of cleaners such as a canister type cleaner.

Specifically, an upright type vacuum cleaner generally employs a cylindrical main body that also partially forms the cleaner body. In the upright type vacuum cleaner, the dust receptacle is mounted to or removed from the cleaner in many ways.

For example, a lifting device is provided at the bottom portion of the dust receptacle to cause the dust receptacle to ascend or descend. Alternatively, a locking device may be provided to fix the dust receptacle in the mounting position.

However, a user is inconvenienced in mounting or removing the dust receptacle, as he has to grip the dust receptacle and operate the lifting or locking device. Furthermore, taking the fact that the dust receptacle in an upright type cleaner is generally large, an attachment for grip of the user, such as a handle, can be provided on the dust receptacle to improve user convenience, which comprises the appearance of the cleaner.

SUMMARY OF THE INVENTION

An aspect of the present disclosure is to address at least the above problems and/or disadvantages and to provide at least the advantages described below. Accordingly, an aspect of the present disclosure is to provide a vacuum cleaner having an improved structure to provide easy mounting and removal, and carrying of a dust receptacle.

In accordance with an aspect of the present disclosure, a vacuum cleaner is provided that includes a cleaner body housing a cyclone dust separating unit therein, a dust receptacle removably mounted in the cyclone dust separating unit, a carrying handle movable at a front of the dust receptacle to protrude out or withdraw in, for carrying of the dust receptacle, and a lifting unit to move in accordance with the protruding or withdrawal of the carrying handle, so as to lock the dust receptacle with the cyclone dust separating unit when the carrying handle is withdrawn in the dust receptacle, and to unlock the dust receptacle from the cyclone dust separating unit when the carrying handle protrudes out of the dust receptacle.

The carrying handle may include a grip for grip by a user, and an operating portion to be inserted in the lifting unit. The lifting unit may include a dust receptacle opening and closing cover on which the operating portion is slidable, to selectively open or close a bottom surface of the dust receptacle, a lifting member disposed on a lower portion of the dust receptacle to ascend or descend according to interference with the operating portion, an elastic member to elastically support the lifting member to a tight contact with the dust receptacle opening and closing cover, and a guide cover to prevent a separation of the lifting member.

The lifting member is moved away from the dust receptacle opening and closing cover to a protruding position by the interference with the operating portion, when the operating portion is inserted in the dust receptacle opening and closing cover.

The operating portion may include a slant and the lifting member may include a slant to face the slant of the operating portion. The dust receptacle may include a seating recess sized to correspond to a grip of the carrying handle, formed on the center of the front of the dust receptacle.

The elastic member may be interposed between the dust receptacle opening and closing cover and the lifting member.

According to the aspects of the present disclosure, the dust receptacle is mounted or dismounted in accordance with the carrying handle of the dust receptacle being inserted or withdrawn. As a result, the user is able to easily remove the dust receptacle from the cleaner by simply gripping and pulling the carrying handle of the dust receptacle, or mount the dust receptacle back into the cleaner by simply inserting the carrying handle.

DESCRIPTION OF THE DRAWING FIGURES

The above and other objects, features, and advantages of certain exemplary embodiments of the present disclosure will be more apparent from the following description taken in conjunction with the accompanying drawings, in which.

DETAILED DESCRIPTION OF THE EXEMPLARY EMBODIMENTS

Hereinafter, the first and second exemplary embodiments of the present disclosure will be described in detail with reference to the accompanying drawing figures.

Figure 1:
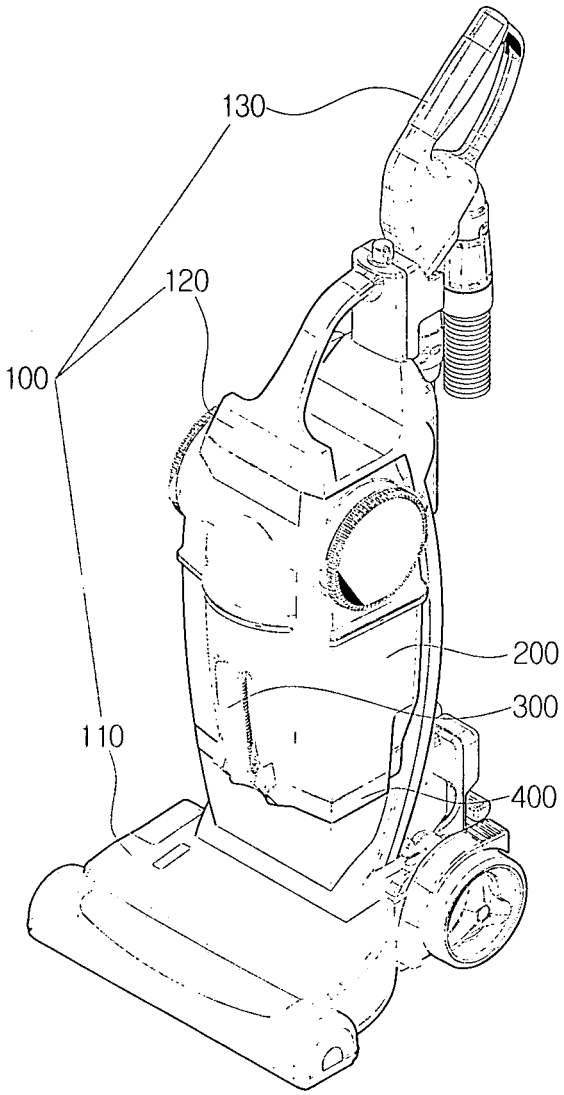
FIG. 1 is a perspective view of a vacuum cleaner according to an exemplary embodiment of the present disclosure illustrating a dust receptacle in a locked state.
Figure 2:
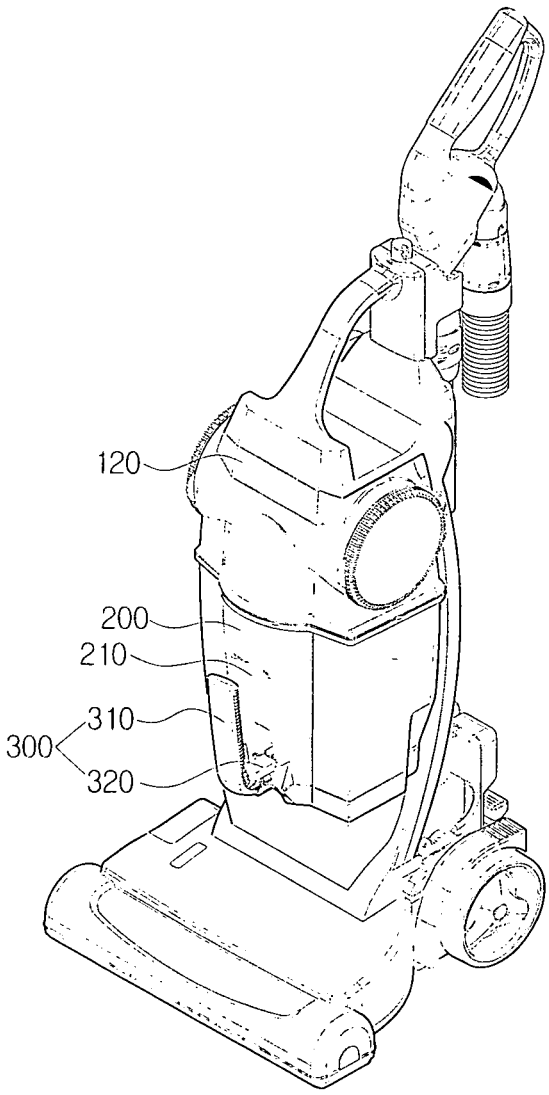
FIG. 2 is a perspective view of the vacuum cleaner of FIG. 1 illustrating the dust receptacle in an unlocked state.
Figure 3:
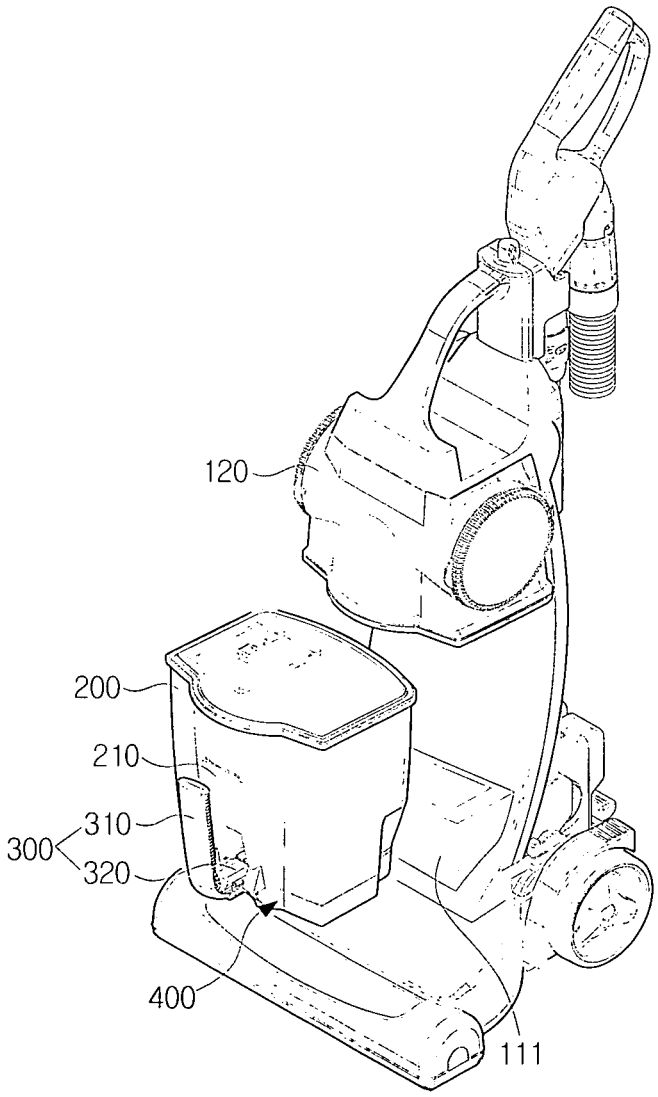
FIG. 3 is a perspective view of the vacuum cleaner of FIG. 1 illustrating the dust receptacle in a removed state.

FIGS. 1 to 3 are perspective views of a vacuum cleaner according to an exemplary embodiment of the present disclosure.

Referring to FIGS. 1 to 3, a vacuum cleaner includes a cleaner body 100, a dust receptacle 200, a carrying handle 300 and a lifting unit 400.

The cleaner body 100 includes a suction nozzle 110 to move along an object being cleaned, a cyclone dust separating unit 120, and an operating handle 130 gripped by a user during cleaning, all of which being integrated into one body.

The dust receptacle 200 is removably disposed on the lower portion of the cyclone dust separating unit 120, to receive dust particles separated from drawn-in air by a centrifugal force of the air in the cyclone dust separating unit 120. The dust receptacle 200 has a handle receiving recess 210 formed on the front, to receive the carrying handle 300 so that the carrying handle 300 does not protrude out.

The carrying handle 300 is arranged to protrude or withdraw at a front portion of the dust receptacle 200, and includes a grip 310 for grip by a user, and an operating portion 320 to be inserted in the lifting unit 400. The carrying handle 300 may be arranged in an 'L' configuration in which the grip 310 and the operating portion 320 are perpendicular to each other.

The lifting unit 400 moves in accordance with the movement of the carrying handle 300 which is protruded or withdrawn, to lock or release the dust receptacle 200 to or from the cyclone dust separating unit 120.

Figure 4:
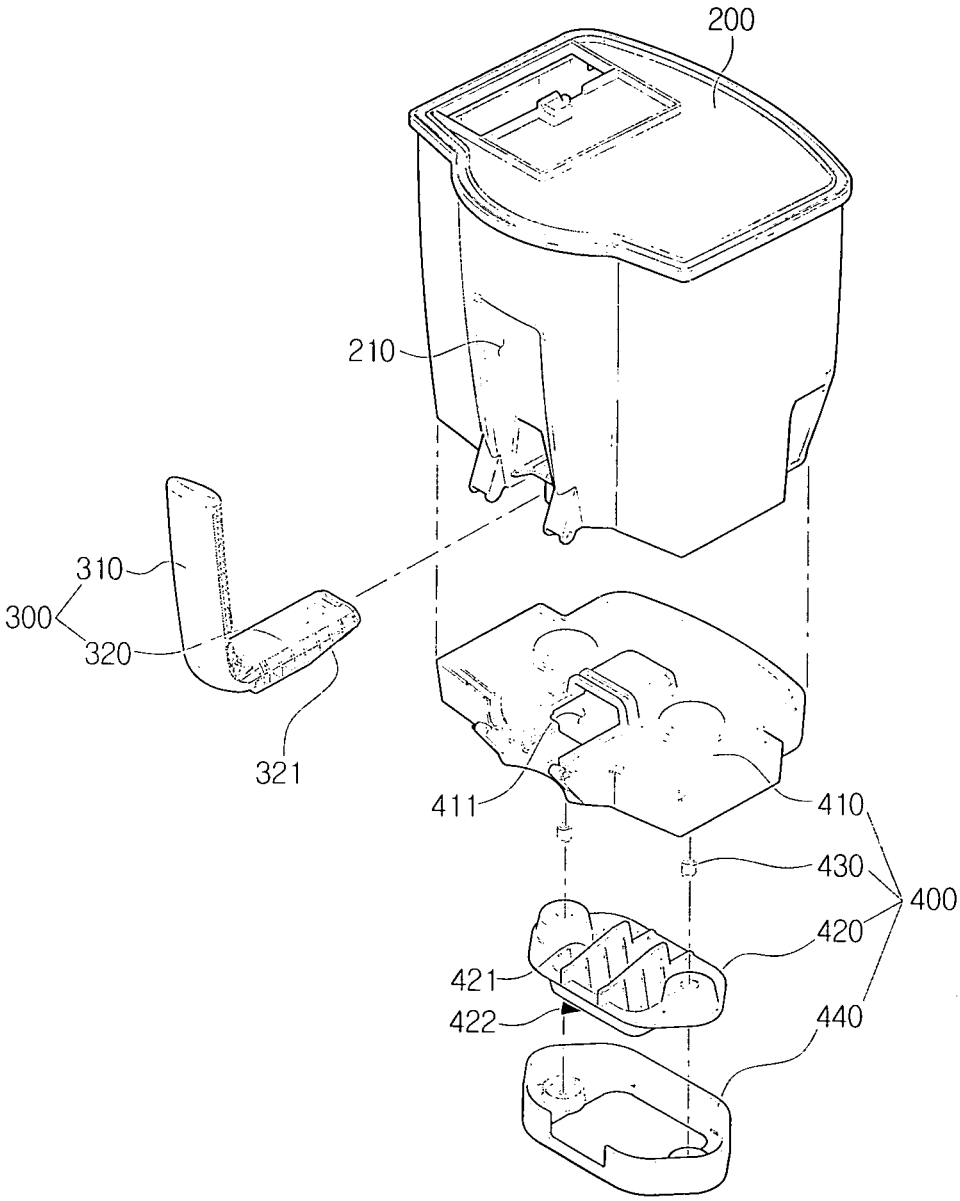
FIG. 4 is an exploded perspective view of a dust receptacle of a vacuum cleaner according to an exemplary embodiment of the present disclosure.
Figure 5:
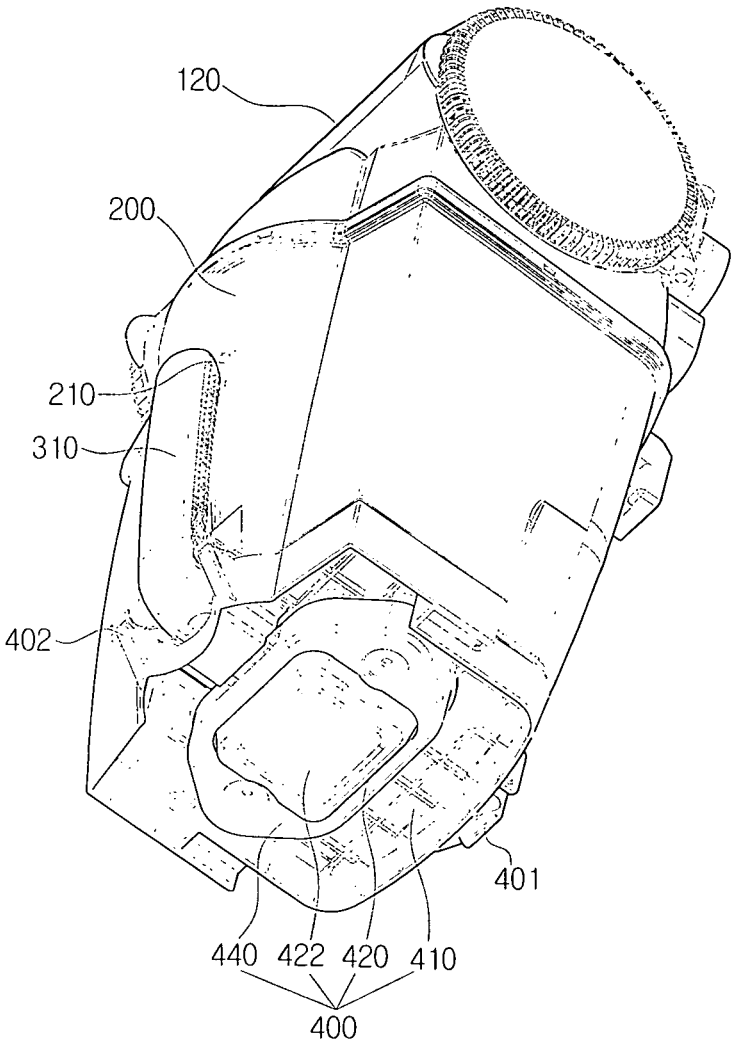
FIG. 5 is a bottom view of the dust receptacle according to an exemplary embodiment of the present disclosure.

Referring to FIGS. 4 and 5, the lifting unit 400 includes a dust receptacle opening and closing cover 410, a lifting member 420, an elastic member 430 and a guide cover 440.

The dust receptacle opening and closing cover 410 is movably disposed on the bottom surface of the dust receptacle 200 to pivot open or close the dust receptacle 200. Accordingly, the user may open the dust receptacle opening and closing cover 410 to empty the dust receptacle 200. The dust receptacle opening and closing cover 410 includes an operating portion inserting hole 411 arranged in a configuration to receive the operating portion 320 therethrough. Referring to FIG. 5, the dust receptacle opening and closing cover 410 may include a locking unit 401 to hook onto the dust receptacle 200, and a pivoting hinge 402.

The lifting member 420 is deformable by the interference with the operating portion 320. According to an exemplary embodiment of the present disclosure, as the operating portion 320 is inserted in the dust receptacle opening and closing cover 410, the lifting member 420 is protruded out by the interference with the operating portion 320 and so is distanced away from the dust receptacle opening and closing cover 410. If the operating portion 320 is withdrawn out of the dust receptacle opening and closing cover 410, the lifting member 420 is released from the interference with the operating portion 320 and so is brought into tight contact with the bottom surface of the dust receptacle opening and closing cover 410. In order to cause such interoperating between the operating portion 320 and the lifting member 420, the operating portion 320 includes a first slant 321 formed on a terminating end, while the lifting member 420 includes a second slant 421 formed on a portion to face the first slant 321. It is desirable that the first and second slants 321 and 421 are arranged to surface-contact with each other according to the protruding and withdrawal of the carrying handle 300.

The elastic member 430 is interposed between the dust receptacle opening and closing cover 410 and the lifting member 420, to elastically support the lifting member 420 to a direction to contact the dust receptacle opening and closing cover 410. The elastic member 430 may be implemented as a coil spring, a plate spring, a torsion spring, or the like, as long as the lifting member 420 is stably supported to a tight contact with the dust receptacle opening and closing cover 410.

The guide cover 440 is formed on the bottom surface of the dust receptacle opening and closing cover 410 to restrict the lifting member 420 so that the lifting member 420 is moved to a predetermined position. The lifting member 420 is interposed between the dust receptacle opening and closing cover 410 and the guide cover 440.

The operation of mounting the dust receptacle to or remove the dust receptacle from the vacuum cleaner body will be explained in greater detail below.

Figure 6:
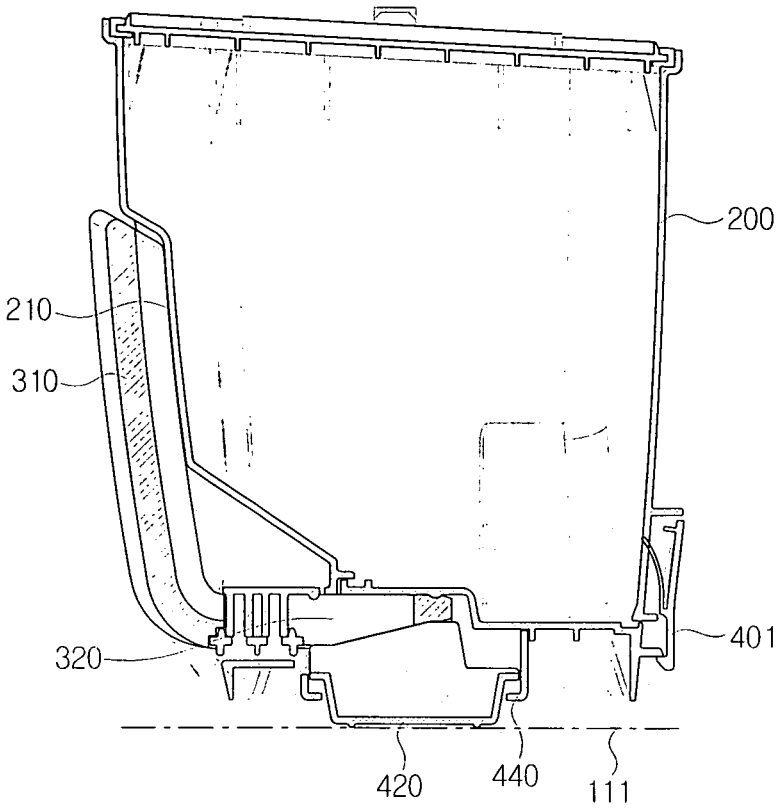
FIGS. 6 to 8 are side cross-sectional views of the dust receptacle of FIG. 4 being locked in a vacuum cleaner according to an exemplary embodiment of the present disclosure.
Figure 7:
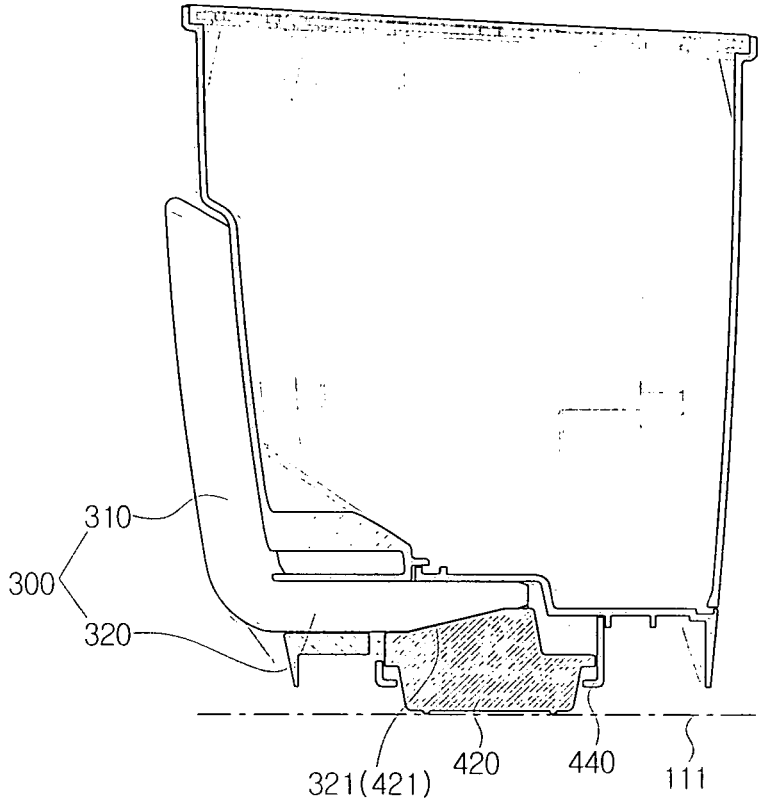
Figure 8:
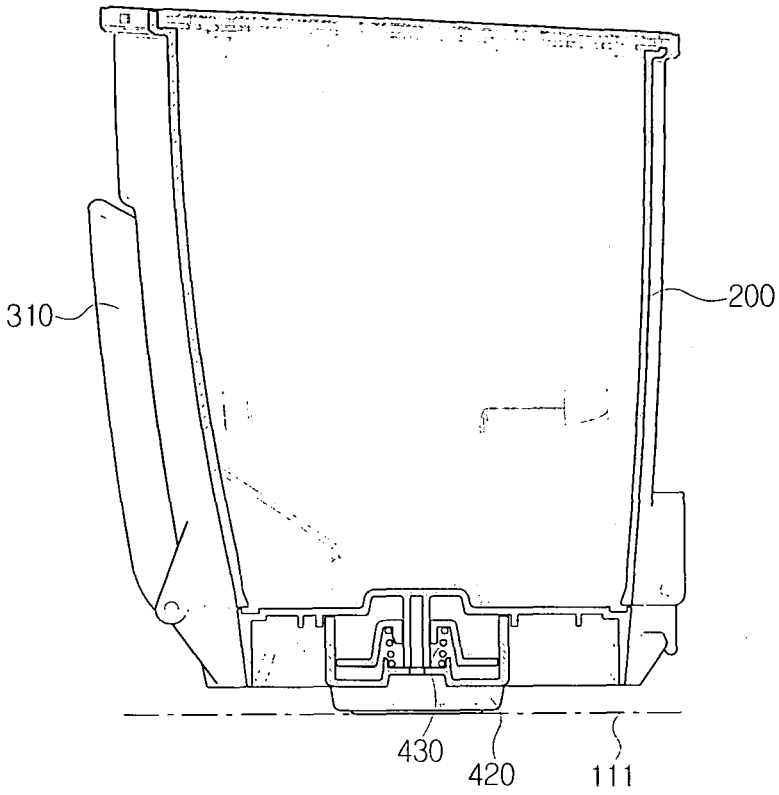

FIGS. 6 to 8 are cross-sectional views to illustrate the interworking of the carrying handle 300 and the lifting unit 400 when the dust receptacle 200 is in locked state.

In a state that the dust receptacle 200 is sealed in the cyclone dust separating unit 120 (FIG. 5), the grip 310 of the carrying handle 300 is received in the handle receiving recess 210 of the carrying handle 300 formed on the center of the front of the dust receptacle 200, to such a depth that a predetermined portion of the grip 310 is exposed outside to make user's access easier.

The lifting member 420 is moved out of the dust receptacle opening and closing cover 410 to a predetermined height, and in this process, a bottom surface 422 of the lifting member 420 contacts a seating surface 111 of the cleaner body, to lift the dust receptacle 200 to the cyclone dust separating unit 120.

Referring to FIG. 7, the first slant 321 of the operating portion 320 keeps surface-contacting the second slant 421 of the lifting member 420, so that the lifting member 420 is pushed downward by the operating portion 320.

FIG. 8 illustrates the elastic member 430 interposed between the dust receptacle opening and closing cover 410 and the lifting member 420 in a state that the lifting member 420 is in an exposed position. As the tensile force of the elastic member 430 applies, the lifting member 420 is moved to a direction of contacting the dust receptacle opening and closing cover 410. However, the lifting member 420 is not moved further, since the lifting member 420 is supported by the first slant 321 of the operating portion 320.

Figure 9:
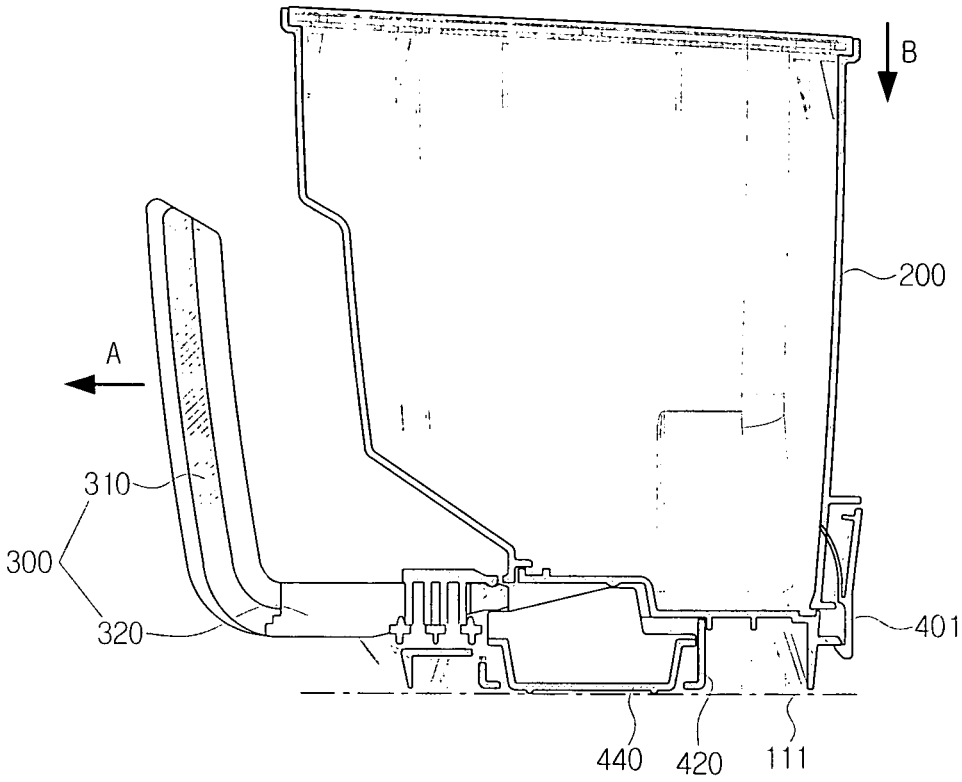
FIGS. 9 to 11 are side cross-sectional views of the dust receptacle of FIG. 4 being unlocked from the vacuum cleaner.
Figure 10:
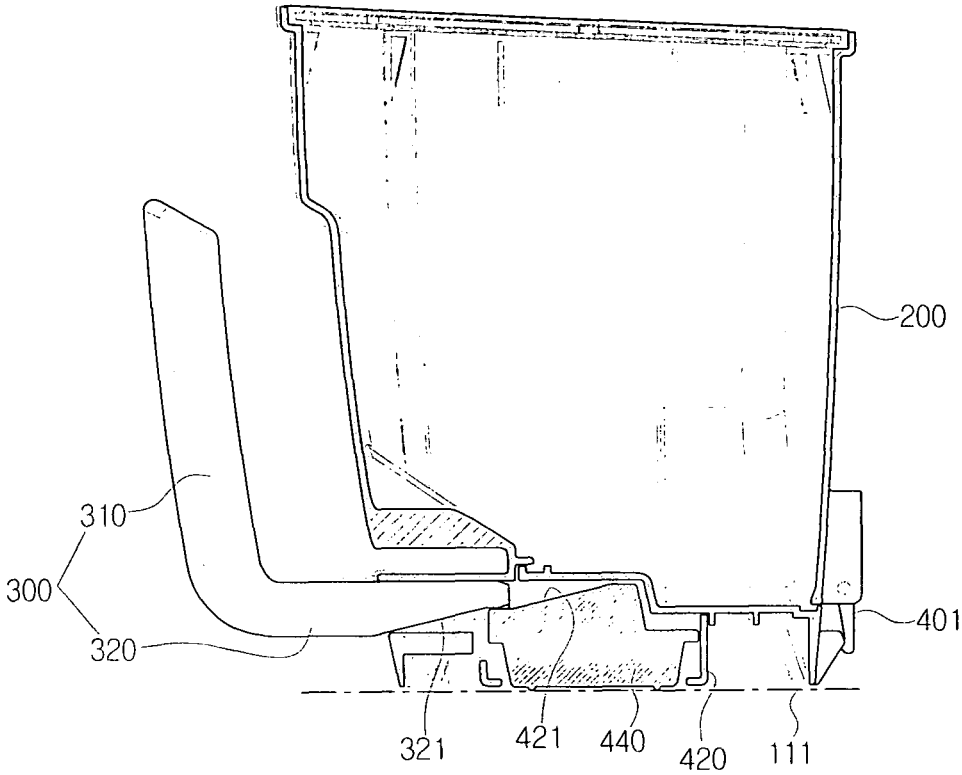
Figure 11:
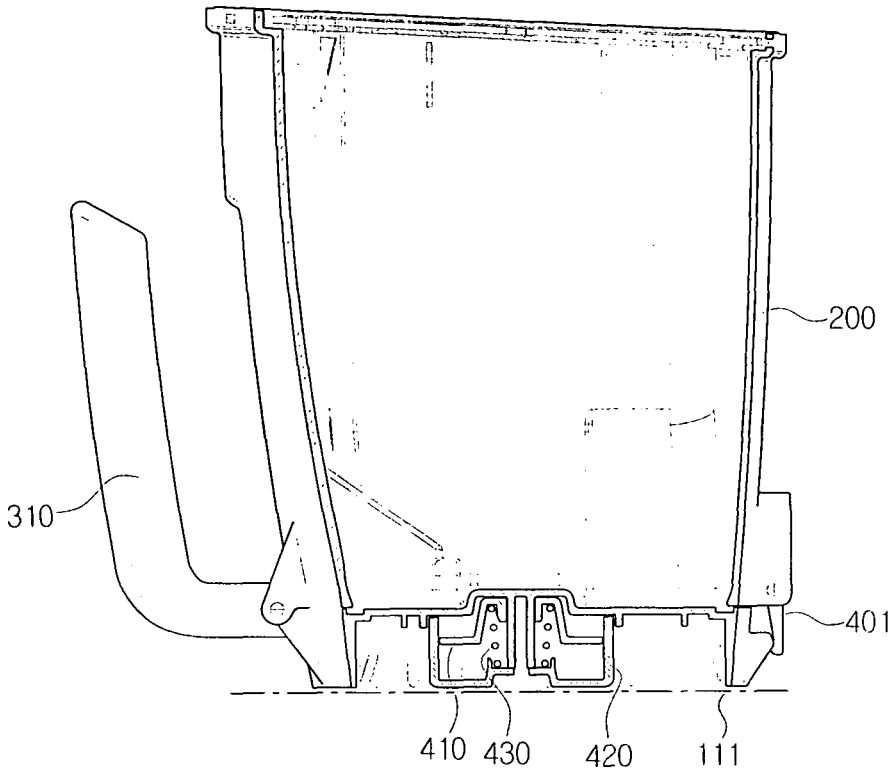

FIGS. 9 to 11 are cross-section views illustrating the interworking of the carrying handle 300 and the lifting unit 400 in a state that the dust receptacle 200 is unlocked from the cleaner body.

In order to remove the dust receptacle 200 from the cyclone dust separating unit 120 (FIG. 5), the dust receptacle 200 has to be moved to the lower portion of the cyclone dust separating unit 120. Accordingly, the user holds the grip 310 of the carrying handle 300 and pulls it in an arrow A direction so that the carrying handle 300 is released out of the handle receiving recess 210 formed at the center of the front portion of the dust receptacle 200 and accordingly, the operating portion 320 is also moved to a direction of being released from the interference with the lifting member 420.

Accordingly, the lifting member 420 is moved by the returning force of the elastic member 430, to a direction to tightly contact the dust receptacle opening and closing cover 410. As the lifting member 420 ascends, the dust receptacle 200 is moved downward in an arrow B direction, so that the seating surface 111, which has contacted the bottom surface 422, is brought into contact with the entire bottom surface of the dust receptacle opening and closing cover 410.

Referring to FIG. 10, the lifting member 420 is received in the dust receptacle opening and closing cover 410, as the first slant 321 of the operating portion 320 is released from the surface-contact with the second slant 421 of the lifting member 420.

FIG. 11 illustrates the elastic member 430 interposed between the dust receptacle opening and closing cover 410 and the lifting member 420 in a state in which the lifting member 420 is received in the dust receptacle opening and closing cover 410. When the operating portion 320, which has restricted the movement of the lifting member 420, retreats, the lifting member 420 is moved by the recovery force of the elastic member 430 to be received in the guide cover 440.

As explained above, the lifting unit 400 is operated to adjust the height of the dust receptacle 200 in accordance with the insertion or withdrawal of the carrying handle 300 of the dust receptacle 200, and since the direction of withdrawing the dust receptacle 200 corresponds to the direction of unlocking the dust receptacle 200, and the direction of mounting the dust receptacle 200 corresponds to the direction of locking the dust receptacle 200, inconveniences of having to do lifting and withdrawing to lock or unlock the dust receptacle 200 is prevented. As a result, the user is conveniently able to separate the dust receptacle 200 from the cyclone dust separating unit 120 by simply pulling the carrying handle 300.

Although representative exemplary embodiment of the present disclosure has been shown and described in order to exemplify the principle of the present disclosure, the present disclosure is not limited to the specific embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A vacuum cleaner comprising:

a cleaner body housing a cyclone dust separating unit therein;

a dust receptacle removably mounted in the cyclone dust separating unit;

a carrying handle on the dust receptacle and movable to protrude out or withdraw in from a front of the dust receptacle; and a lifting unit to move in accordance with the protruding or withdrawal of the carrying handle, so as to lock the dust receptacle with the cyclone dust separating unit when the carrying handle is withdrawn in the dust receptacle, and to unlock the dust receptacle from the cyclone dust separating unit when the carrying handle protrudes out of the dust receptacle, wherein the lifting unit is installed on a bottom of the dust receptacle and is detachable from the dust receptacle at a predetermined interval.

2. The vacuum cleaner of claim 1, wherein the carrying handle comprises a grip for grip by a user and an operating portion to be inserted in the lifting unit.

3. A vacuum cleaner comprising:

a cleaner body housing a cyclone dust separating unit therein;

a dust receptacle removably mounted in the cyclone dust separating unit;

a carrying handle movable at a front of the dust receptacle to protrude out or withdraw in; and a lifting unit to move in accordance with the protruding or withdrawal of the carrying handle, so as to lock the dust receptacle with the cyclone dust separating unit when the carrying handle is withdrawn in the dust receptacle, and to unlock the dust receptacle from the cyclone dust separating unit when the carrying handle protrudes out of the dust receptacle, wherein the carrying handle comprises a grip for grip by a user and an operating portion to be inserted in the lifting unit, and wherein the lifting unit comprises:

a dust receptacle opening and closing cover on which the operating portion is slidable, to selectively open or close a bottom surface of the dust receptacle;

a lifting member disposed on a lower portion of the dust receptacle to ascend or descend according to interference with the operating portion;

an elastic member to elastically support the lifting member to a tight contact with the dust receptacle opening and closing cover; and a guide cover to prevent a separation of the lifting member.

4. The vacuum cleaner of claim 3, wherein the lifting member is moved away from the dust receptacle opening and closing cover to a protruding position by the interference with the operating portion, when the operating portion is inserted in the dust receptacle opening and closing cover.

5. The vacuum cleaner of claim 4, wherein the operating portion comprises a first slant and the lifting member comprises a second slant to face the first slant of the operating portion.

6. The vacuum cleaner of claim 5, wherein the dust receptacle comprises a seating recess sized to correspond to a grip of the carrying handle, formed on the center of the front of the dust receptacle.

7. The vacuum cleaner of claim 3, wherein the elastic member is interposed between the dust receptacle opening and closing cover and the lifting member.

* * * * *